US009236001B2

(12) United States Patent
Ishii et al.

(10) Patent No.: US 9,236,001 B2
(45) Date of Patent: Jan. 12, 2016

(54) METHOD OF DRIVING ELECTRO-OPTIC DEVICE AND ELECTRO-OPTIC DEVICE IN WHICH LIGHT EMITTING ELEMENTS EMIT LIGHT CONCURRENTLY IN A PERIOD DURING ONE FRAME

(75) Inventors: Ryo Ishii, Yokohama (JP); Hirofumi Katsuse, Yokohama (JP); Takeshi Okuno, Yokohama (JP); Naoaki Komiya, Yokohama (JP)

(73) Assignee: Samsung Display Co., Ltd., Yongin-si (KR)

( * ) Notice: Subject to any disclaimer, the term of this patent is extended or adjusted under 35 U.S.C. 154(b) by 164 days.

(21) Appl. No.: 13/609,226

(22) Filed: Sep. 10, 2012

(65) Prior Publication Data

US 2013/0113690 A1 May 9, 2013

(30) Foreign Application Priority Data

Nov. 9, 2011 (JP) ..... 2011-245724

(51) Int. Cl.
*G09G 3/32* (2006.01)
*G09G 3/00* (2006.01)

(52) U.S. Cl.
CPC ..... *G09G 3/003* (2013.01); *G09G 3/3233* (2013.01); *G09G 2300/0819* (2013.01); *G09G 2300/0842* (2013.01); *G09G 2300/0861* (2013.01)

(58) Field of Classification Search
CPC . G09G 3/3208; G09G 3/3258; G09G 3/3233; G09G 3/3291; G09G 2310/0251
USPC ..... 345/36, 39, 44–46, 74.1–83; 315/169.3; 313/463
See application file for complete search history.

(56) References Cited

U.S. PATENT DOCUMENTS

| | | | | |
|---|---|---|---|---|
| 7,535,449 | B2 * | 5/2009 | Miyazawa | 345/92 |
| 8,054,250 | B2 | 11/2011 | Kim | |
| 8,674,914 | B2 | 3/2014 | Ohhashi | |
| 9,064,458 | B2 | 6/2015 | Lee | |
| 2006/0022305 | A1 * | 2/2006 | Yamashita | 257/565 |
| 2006/0097966 | A1 * | 5/2006 | Choi | 345/77 |
| 2011/0025671 | A1 * | 2/2011 | Lee | 345/211 |

FOREIGN PATENT DOCUMENTS

| | | |
|---|---|---|
| JP | 2005-99773 A | 4/2005 |
| JP | 2008-040444 | 2/2008 |
| JP | 2010-113230 A | 5/2010 |
| JP | 2011-034039 | 2/2011 |
| KR | 10-2007-0081950 | 8/2007 |

(Continued)

*Primary Examiner* — Ram Mistry
(74) *Attorney, Agent, or Firm* — Christie, Parker & Hale, LLP

(57) ABSTRACT

A driving method of an electro-optic device is capable of sufficiently providing a threshold voltage compensation time of a driving transistor and a data writing time. A driving method of an electro-optic device including a first power source, a second power source, data lines, scan lines, signal lines, and pixel circuits, includes: a first step in which a light emitting element is in a non-light-emitting state, and a second transistor is turned on by a change of a pulse applied to a signal line; and a second step in which the scan line is sequentially and exclusively selected after the second transistor is turned on, a third transistor including a gate connected to a selected scan line is turned on, and a corresponding data voltage is written to a first node from the data line through the third transistor.

13 Claims, 16 Drawing Sheets

(56) References Cited

FOREIGN PATENT DOCUMENTS

| | | | |
|---|---|---|---|
| KR | 10-2009-0048823 | | 5/2009 |
| KR | 10-2011-0013693 | A | 2/2011 |
| KR | 10-1073281 | | 10/2011 |
| WO | WO 2009/050923 | A1 | 4/2009 |
| WO | WO 2010/016316 | A1 | 2/2010 |

* cited by examiner

METHOD OF DRIVING ELECTRO-OPTIC DEVICE AND ELECTRO-OPTIC DEVICE IN WHICH LIGHT EMITTING ELEMENTS EMIT LIGHT CONCURRENTLY IN A PERIOD DURING ONE FRAME

CROSS-REFERENCE TO RELATED APPLICATION

This application claims priority to and the benefit of Japanese Patent Application No. 2011-245724 filed in the Japan Patent Office on Nov. 9, 2011, the entire contents of which are incorporated herein by reference.

BACKGROUND (a) Field

Embodiments of the present invention relate to a driving method of an electro-optic device, and an electro-optic device.

(b) Description of the Related Art

As a display unit for a television set, a liquid crystal display (LCD) including a transmissive or transflective liquid crystal panel, or an organic light emitting diode (OLED) display including an organic light emitting diode (OLED) panel consisting of a number of organic light emitting elements, is widely used.

Recently, high-speed driving of a pixel circuit in an electro-optic device has been used in a display of a high resolution or a 3-D image.

While performing the high-speed driving, it is difficult to obtain sufficient threshold voltage compensation time and data writing time of the driving transistor in the pixel circuit such that deterioration of the display quality may be generated.

To solve these problems, increasing the number of transistors and/or capacitors in the pixel circuit cannot be avoided. However, a technique of reducing the number of elements of the pixel circuit is disclosed in the following Patent Document 1 and Patent Document 2.

Patent Document 1: KR Patent publication No. 10-2010-113230

Patent Document 2: KR Patent publication No. 10-2005-099773

However, in these techniques, the threshold voltage compensation of the driving transistor, and the data writing and reference potential writing of the pixel circuit, are performed during each scan line selection period such that the threshold voltage compensation time of the driving transistor and the data writing time may not be sufficiently obtained, and thereby the deterioration of the display quality may still occur.

Particularly, these problems are more significant when the scan line selection period is short while performing surface sequential driving for the 3-D image display.

The above information disclosed in this Background section is only for enhancement of understanding of the background of the invention and therefore may contain information that does not form the prior art that is already known in this country to a person of ordinary skill in the art.

SUMMARY

Exemplary embodiments of the present invention sufficiently obtain a threshold voltage compensation time of a driving transistor and a data writing time while reducing a number of elements of a pixel circuit. In addition, the present invention provides a driving method of an electro-optic device and an electro-optic device in which deterioration of display quality is prevented.

A driving method of an electro-optic device including a first power source, a second power source, a plurality of data lines, a plurality of scan lines, a plurality of signal lines, and a plurality of pixel circuits formed at a crossing region of the data lines and the scan lines according to an exemplary embodiment of the present invention includes: a first step in which a light emitting element is in a non-light-emitting state and a second transistor is turned on by a change of a pulse applied to a signal line; and a second step in which a scan line is sequentially and exclusively selected after the second transistor is turned on, a third transistor including a gate connected to the selected scan line is turned on, and a corresponding data voltage is written to a first node from the data line through the third transistor for the electro-optic device in which the light emitting element emits light in a predetermined period among one frame all together for all pixel circuits. Each pixel circuit includes: a light emitting element configured to emit light in response to a current flowing to the second power source from the first power source; a first transistor including a first terminal connected to the first power source, a gate connected to a second node, and a second terminal connected to the second power source; a second transistor including a first terminal connected to the second node, a gate connected to a corresponding one of the signal lines, and a second terminal connected to the second terminal of the first transistor; a third transistor including a first terminal connected to a corresponding one of the data fines, a gate connected to a corresponding one of the scan lines, and a second terminal connected to the first node; and a capacitor including a terminal connected to the first node and another terminal connected to the second node.

According to this method, when the light emitting element is in the non-light-emitting state, after the second transistor is turned on by the change of the pulse applied to the signal fine, the scan line is sequentially and exclusively selected, the third transistor including the gate connected to the selected scan line is turned on, and the data voltage corresponding to a selected pixel is written to the first node through the third transistor from the data line.

As a result, the driving method of the electro-optic device according to the present invention sufficiently obtains a threshold voltage compensation time of the driving transistor and the data writing time while reducing the number of pixel circuits, thereby preventing deterioration of the display quality.

The driving method may further include a third step in which all scan lines are concurrently selected to turn on the third transistor such that a predetermined reference voltage may be written to the first node through the third transistor from the data line after the second step.

The driving method may further include a fourth step in which the current may flow to the second power source from the first power source, and the light emitting element may emit light with a brightness corresponding to a voltage value of the second node after the third step.

The electro-optic device may further include a plurality of controlling lines, each of the pixel circuits may further include a fourth transistor including a first terminal connected to the second terminal of the first transistor, a gate connected to a corresponding one of the controlling lines, and a second terminal connected to an anode of the light emitting element, and for the fourth step, the fourth transistor may be turned on by a change of a pulse applied to the controlling line such that a current may flow to the second power source from the first power source.

For the fourth step, the potential of the second power source may be lower than the potential of the first power source such that the current may flow to the second power source from the first power source.

For the third step, the second transistor of each of the pixel circuits may be turned off all together for all of the pixel circuits.

For the second step, the second transistor may be sequentially turned off every scan line.

The electro-optic device may further include a plurality of reset lines and a reset power source, each of the pixel circuits may further include a fifth transistor including a first terminal connected to the second node, a gate connected to a corresponding one of the reset lines, and a second terminal connected to the reset power source, and after the fourth step, the fifth transistor may be turned on by a change of a pulse applied to the reset line such that the second node may be connected to the reset power source to set a predetermined reset potential.

The electro-optic device may further include a plurality of reset lines, each of the pixel circuits may further include a sixth transistor including a first terminal connected to the second node, a gate connected to a corresponding one of the reset lines, and a second terminal connected to the data line, and after the fourth step, the potential of the data line may be determined as a predetermined reset potential, and the sixth transistor may be turned on by a change of the pulse applied to the reset line such that the second node may be connected to the data line to be set up as the predetermined reset potential.

An electro-optic device includes a first power source, a second power source, a plurality of data lines, a plurality of scan lines, a plurality of signal lines, and a plurality of pixel circuits formed in crossing regions of the data lines and the scan lines, and each of the pixel circuits includes: a light emitting element configured to emit light in response to a current flowing to the second power source from the first power source; a first transistor including a first terminal connected to the first power source, a gate connected to a second node, and a second terminal connected to a drain of the second transistor and the second power source; a second transistor including a first terminal connected to the second node, the gate connected to a corresponding one of the signal lines, and a second terminal connected to the second terminal of the first transistor; a third transistor including a first terminal connected to a corresponding one of the data lines, a gate connected to a corresponding one of the scan lines, and a second terminal connected to a first node; and a capacitor including a terminal connected to the first node and another terminal connected to the second node, wherein the light emitting element of each of the pixel circuits is configured to emit light in a predetermined period during one frame all together for all of the pixel circuits, and during compensation of a threshold voltage of the first transistor, a data voltage corresponding to the pixel circuit selected by scanning of the scan line, is written to the first node from the data line through the third transistor.

The electro-optic device may further include a plurality of controlling lines, and each of the pixel circuits may further include a fourth transistor including a first terminal connected to the second terminal of the first transistor, a gate connected to a corresponding one of the controlling lines, and a second terminal connected to an anode of the light emitting element.

The electro-optic device may further include a plurality of reset lines and a reset power source, and each of the pixel circuits may further include a fifth transistor including a first terminal connected to the second node, a gate connected to a corresponding one of the reset lines, and a second terminal connected to the reset power source.

The electro-optic device may further include a plurality of reset lines, each of the pixel circuits may further include a sixth transistor including a first terminal connected to the second node, a gate connected to a corresponding one of the reset lines, and a second terminal connected to a corresponding one of the data lines.

The first transistor, the second transistor, and the third transistor may each be a P-channel type MOSFET (metal-oxide-semiconductor field-effect transistor).

As a result, the threshold voltage compensation time of the driving transistor and the data writing time may be sufficiently obtained while reducing the number of pixel circuits, thereby preventing or reducing deterioration of display quality such that a new and improved driving method of the electro-optic device and the electro-optic device may be provided.

DETAILED DESCRIPTION OF THE EMBODIMENTS

Figure 1:
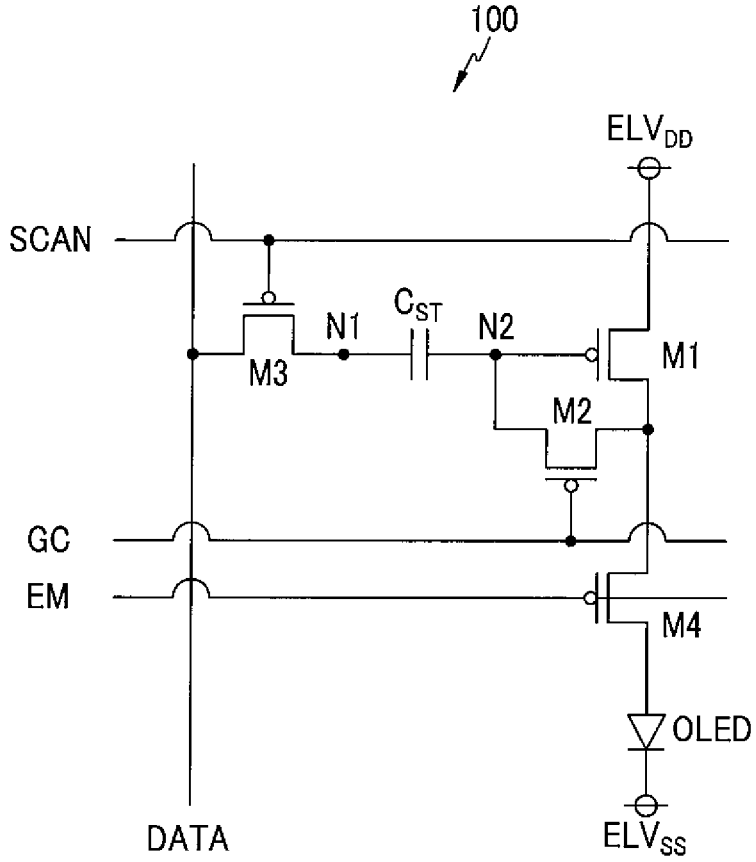
FIG. 1 is a diagram of a pixel circuit of an electro-optic device according to a first exemplary embodiment of the present invention.

Hereinafter, the present invention will be described more fully with reference to the accompanying drawings, in which exemplary embodiments of the invention are shown. As those skilled in the art would realize, the described exemplary embodiments may be modified in various different ways, all without departing from the spirit or scope of the present invention.

Constituent elements having the same structures throughout the embodiments are denoted by the same reference numerals and are described in a first embodiment. In the other embodiments, only constituent elements other than the same constituent elements will be described.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Now, an exemplary embodiment of the present invention will be described in detail with reference to accompanying drawings.

In the present specification and drawings, elements substantially having the same function are indicated by like reference numbers and overlapping description thereof is omitted.

<1. First Exemplary Embodiment>

[Constitution of a Pixel Circuit of an Electro-optic Device]

Firstly, a constitution of a pixel circuit of an electro-optic device according to a first exemplary embodiment of the present invention will be described.

FIG. 1 is a diagram of a pixel circuit 100 of an electro-optic device according to the first exemplary embodiment of the present invention.

The electro-optic device according to the first exemplary embodiment of the present invention has a matrix type structure in which the pixel circuit 100 shown in FIG. 1 is disposed at a crossing position of, for example, a scan line of an n-th row and a data line of an m-th column.

Next, the pixel circuit of the electro-optic device according to the first exemplary embodiment of the present invention will be described with reference to FIG. 1.

As shown in FIG. 1, the pixel circuit 100 of the electro-optic device according to the first exemplary embodiment of the present invention includes a first transistor M1, a second transistor M2, a third transistor M3, a fourth transistor M4, a capacitor $C_{ST}$, and a light emitting element, e.g., an organic light emitting element (OLED).

The first transistor M1 includes a first terminal connected to a first power source $ELV_{DD}$, a gate connected to a second node N2, and a second terminal connected to a second terminal of the second transistor M2 and a first terminal of the fourth transistor M4.

The second transistor M2 includes a first terminal connected to the second node N2, a gate connected to a signal line GC, and the second terminal connected to the second terminal of the first transistor M1 and the first terminal of the fourth transistor M4.

The third transistor M3 includes a first terminal connected to a data line DATA, a gate connected to a scan line SCAN, and a second terminal connected to a first node N1.

The fourth transistor M4 includes a gate connected to a controlling line EM and a second terminal connected to an emitter of the light emitting element (OLED).

In the pixel circuit 100, the first transistor M1, the second transistor M2, the third transistor M3, and the fourth transistor M4 are all P channel-type MOSFETs (metal-oxide-semiconductor field-effect transistors) according to the first embodiment.

The capacitor $C_{ST}$ includes one terminal connected to the first node N1 and another terminal connected to the second node N2.

The scan line SCAN supplies a control pulse to turn the third transistor M3 on or off.

The third transistor M3 is turned on or off by the control pulse supplied to the scan line SCAN.

The data line DATA supplies a data signal to the pixel circuit 100.

If the third transistor M3 is turned on by the control pulse supplied to the scan line SCAN, the data voltage corresponding to the pixel circuit 100 is written to the first node N1 through the third transistor M3.

The signal line GC supplies a control pulse for turning the second transistor M2 on or off.

The second transistor M2 is turned on or off by the control pulse supplied to the signal line GC.

The controlling line EM supplies a control pulse for turning the fourth transistor M4 on or off.

For a period in which the fourth transistor M4 is turned on or off by the control pulse of the controlling line EM, when the fourth transistor M4 is turned on, a current according to a potential that is maintained at the second node N2 of the pixel circuit 100 flows to the light emitting element OLED.

The light emitting element (OLED), e.g., the organic light emitting element, is an element that self-emits light according to an amount of a current flowing between an anode and a cathode thereof.

In the present exemplary embodiment, as described above, during the period in which the fourth transistor M4 is turned on by the control pulse supplied to the controlling line EM, the current according to the potential that is maintained at the second node N2 of the pixel circuit 100, flows to the light emitting element (OLED), and thereby the light emitting element (OLED) becomes self-emissive by this current.

In the electro-optic device according to the first exemplary embodiment of the present invention, for all pixel circuits 100, the control pulse to turn on all fourth transistors M4 is supplied by the controlling line EM.

Accordingly, the electro-optic device according to the first exemplary embodiment of the present invention is driven with a surface sequence.

The constitution of the pixel circuit 100 of the electro-optic device according to the first exemplary embodiment of the present invention was described with reference to FIG. 1.

Next, a driving method of the pixel circuit 100 of the electro-optic device according to the first exemplary embodiment of the present invention will be described.

[Driving Method of the Pixel Circuit of the Electro-optic Device]

Figure 2:
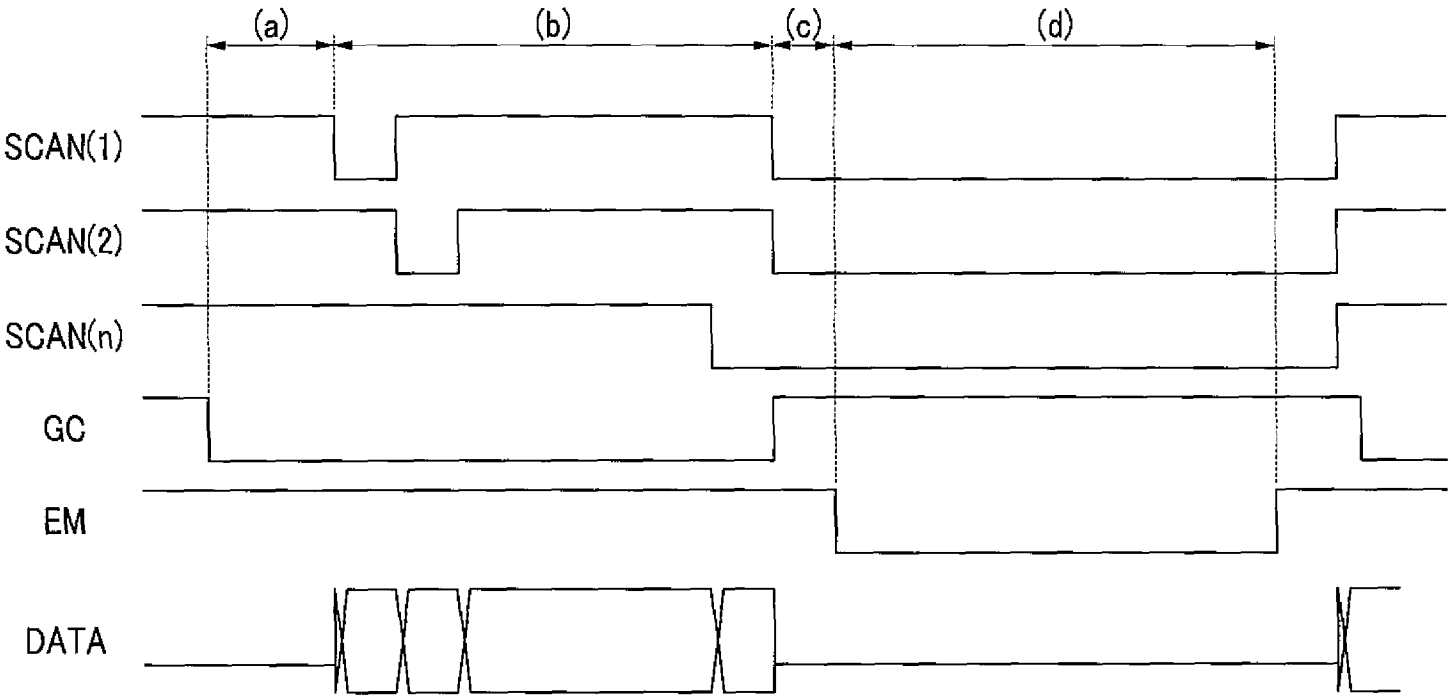
FIG. 2 is a diagram of a timing chart of each signal used to drive the pixel circuit of an electro-optic device according to the first exemplary embodiment of the present invention.

FIG. 2 is a diagram of a timing chart of each signal used to drive the pixel circuit 100 of an electro-optic device according to the first exemplary embodiment of the present invention, and FIG. 3A through FIG. 3D are diagrams of several driving states of the pixel circuit 100 of an electro-optic device according to the first exemplary embodiment of the present invention.

Next, a driving method of the pixel circuit 100 of the electro-optic device according to the first exemplary embodiment of the present invention will be described with reference to FIG. 2 and FIG. 3A through FIG. 3D.

In the timing chart shown in FIG. 2, for a period when control pulses are respectively supplied to the scan line SCAN(1) of the first row, the scan line SCAN(2) of the second row, and the scan line SCAN(n) of the n-th row, the control pulse supplied to the signal line GC, the control pulse supplied to the controlling line EM, and the data signal supplied to the data line DATA are shown.

Figure 3A:
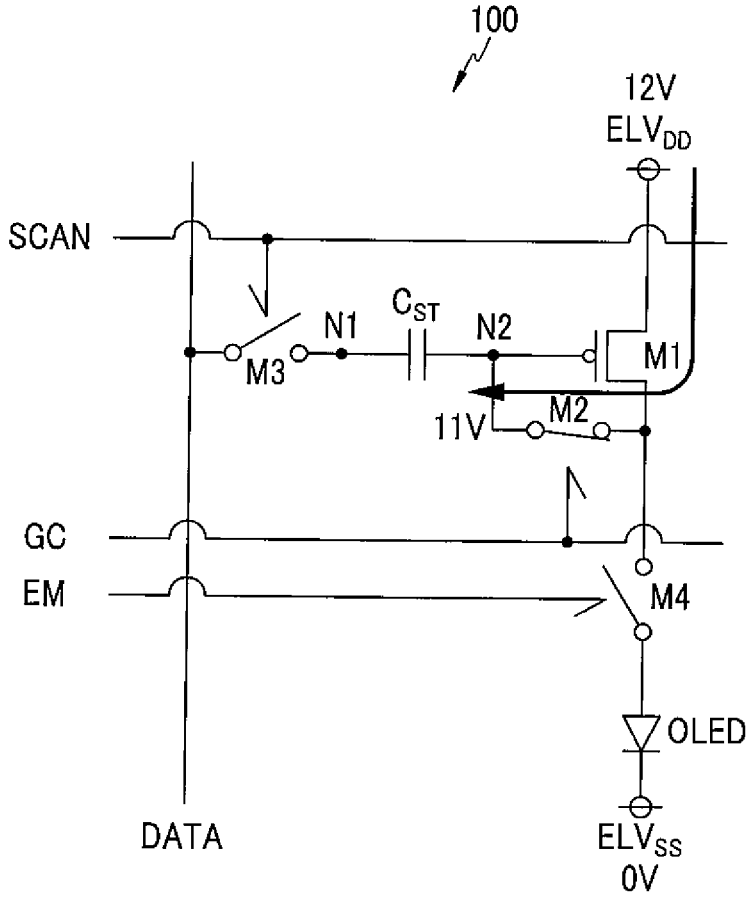
FIG. 3A is a diagram of a driving state of the pixel circuit of an electro-optic device according to the first exemplary embodiment of the present invention.

For the period (a) of FIG. 2 and as illustrated in FIG. 3A, the control pulse supplied to the controlling line EM is a high level such that the fourth transistor M4 is turned off, and the control pulse supplied to the signal line GC is a low level such that the second transistor M2 is turned on.

Thus, the light emitting element (OLED) enters a non-light-emitting state, and the first transistor M1 enters a diode connection state (e.g., diode-connected).

When the first transistor M1 is put in the diode connection state by turning on the second transistor M2, the voltage of the second node N2 starts to be changed toward a voltage equal to $ELV_{DD}$-Vth (where Vth is a threshold voltage of the first transistor M1).

In FIG. 3A, it is assumed that $ELV_{DD}$=12 V and Vth=1 V.

Accordingly, the potential of the second node N2 becomes 11 V.

In the present invention, however, the values of $ELV_{DD}$ and Vth are not limited thereto.

Figure 3B:
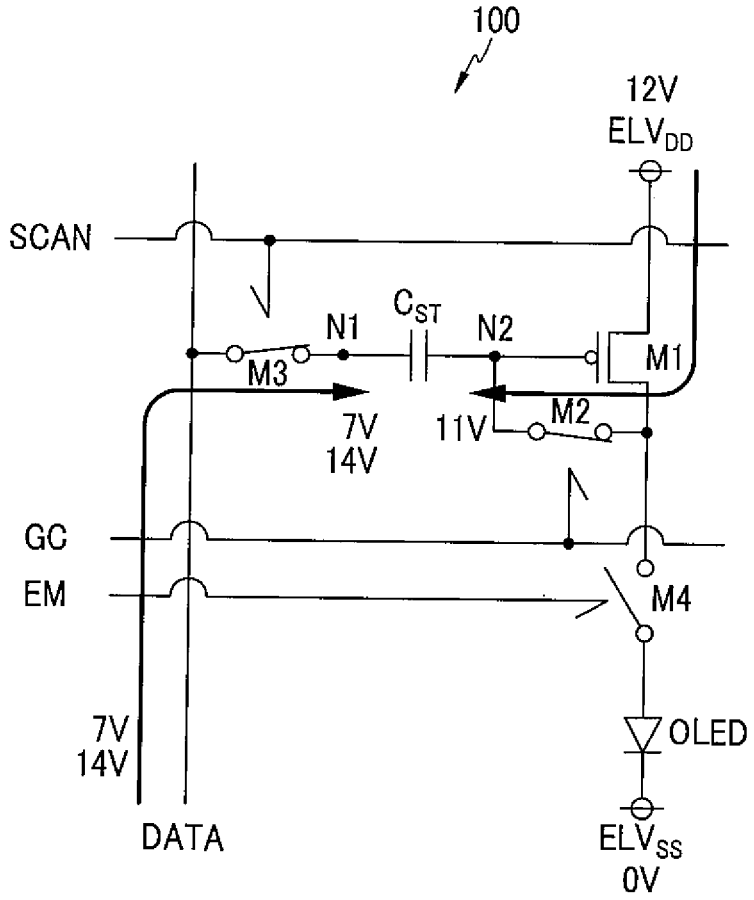
FIG. 3B is a diagram of a driving state of the pixel circuit of an electro-optic device according to the first exemplary embodiment of the present invention.

Continuously, for the period (b) of FIG. 2 and as illustrated in FIG. 3B, each of the scan lines SCAN 1, SCAN 2, . . . , SCAN(n) is sequentially and exclusively selected, and the third transistor M3 connected to the selected scan line is turned on.

If the third transistor M3 connected to the selected scan line is turned on, the data voltage VDATA corresponding to the selected pixel is written to the first node N1 through the third transistor M3 from the data line DATA.

For the period (b) of FIG. 2, a data voltage VDATA supplied from the data line DATA is determined by a gray level or degree and a reference potential Vbas that will be described later. In the exemplary embodiment of FIG. 3B, the data voltage VDATA is determined as being in a range of about 7 V to about 14 V.

For the period (b) of FIG. 2, the first transistor M1 maintains the diode connection state such that the voltage at the second node N2 is continuously changed until the voltage is substantially equal to $ELV_{DD}$-Vth, and the voltage charged to the capacitor $C_{ST}$ becomes $ELV_{DD}$-Vth-VDATA with reference to the first node N1.

Figure 3C:
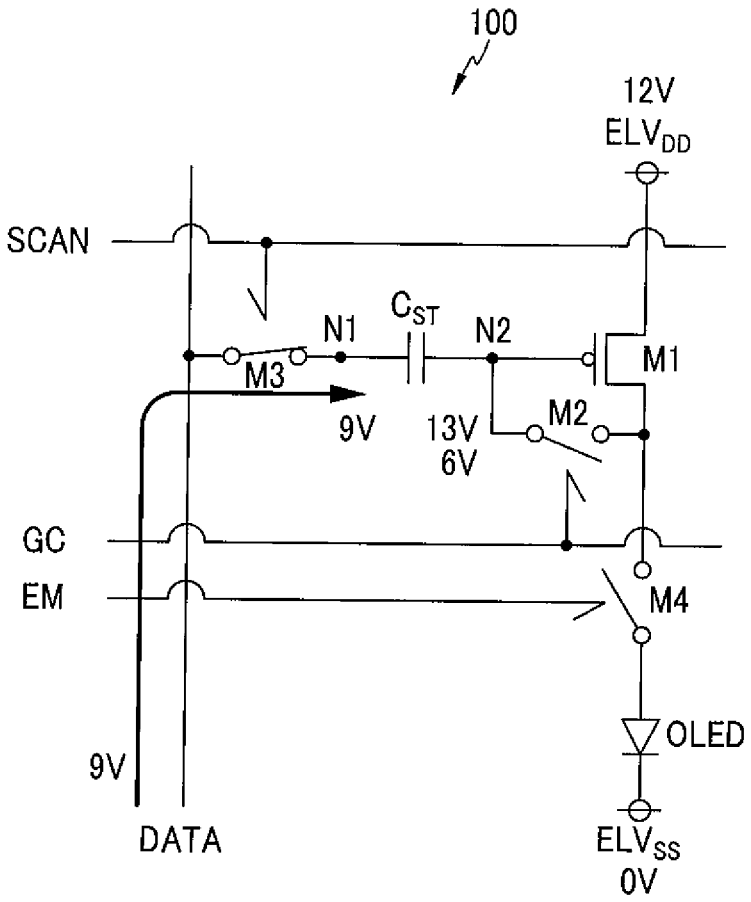
FIG. 3C is a diagram of a driving state of the pixel circuit of an electro-optic device according to the first exemplary embodiment of the present invention.

Next, for the period (c) of FIG. 2 and as illustrated in FIG. 3C, by transmitting the control pulse supplied to the signal line GC as the high level, the second transistor M2 is turned off, and concurrently (e.g., simultaneously) all scan lines SCAN 1, SCAN 2, . . . , SCAN(n) are selected such that the third transistors M3 of all pixel circuits 100 are turned on.

For the period (c) of FIG. 2, the data voltage VDATA is applied with a reference potential Vbas (e.g., in FIG. 3C, 9 V) such that the potential Vbas is written to the first node N1 of all pixel circuits 100 through the third transistor M3.

According to the writing of the potential Vbas to the first node N1, the potential of the second node N2 becomes $ELV_{DD}$-Vth-VDATA+Vbas by capacitive coupling of the capacitor $C_{ST}$.

Accordingly, when the data voltage VDATA is in the range of about 7 V to about 14 V, the potential of the second node N2 is maintained in the range of about 6 V to about 13 V.

Figure 3D:
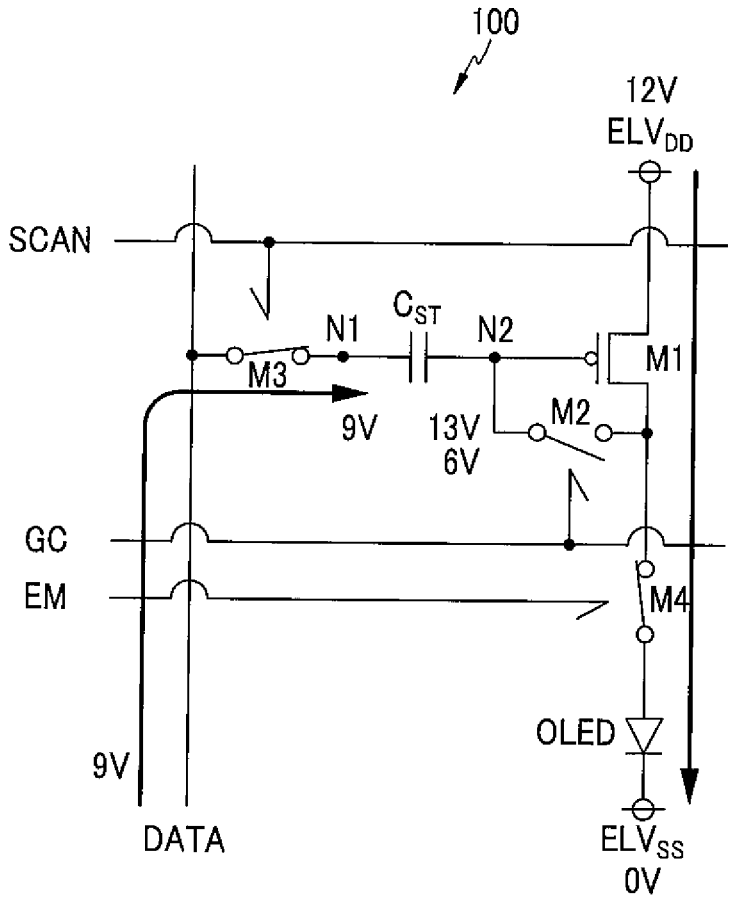
FIG. 3D is a diagram of a driving state of the pixel circuit of an electro-optic device according to the first exemplary embodiment of the present invention.

Continuously, for the period (d) of FIG. 2 and as illustrated in FIG. 3D, for all pixel circuits 100, the control pulse supplied to the controlling line EM is the low level such that the fourth transistors M4 are concurrently (e.g., simultaneously) turned on for all pixel circuits 100.

When the fourth transistor M4 is turned on, the light emitting of the light emitting element (OLED) according to the potential maintained by the second node N2 of each pixel circuit 100 is performed.

Also, during the period (c) of FIG. 2, the third transistor M3 is continuously turned on such that the first node N1 is maintained at the reference potential Vbas.

The first node N1 is maintained at the reference potential Vbas such that the potential $ELV_{DD}$-Vth-VDATA+Vbas of the second node N2 is maintained during the period (d).

The driving method of the pixel circuit 100 of the electro-optic device according to the first exemplary embodiment of the present invention is described above.

By driving the pixel circuit 100 of the electro-optic device according to the first exemplary embodiment of the present invention, the capacitor that occupies a relatively large area on a layout of the pixel circuit 100 may be limited to one capacitor $C_{ST}$.

Also, for the surface sequential driving of the pixel circuit 100 of the electro-optic device according to the first exemplary embodiment of the present invention, the compensation time of the threshold voltage of the first transistor M1 and the data writing time may be increased.

Accordingly, in the electro-optic device according to the first exemplary embodiment of the present invention, the compensation time of the threshold voltage of the first transistor M1 and the data writing time may be sufficiently obtained while reducing a number of pixel circuits such that the deterioration of the display quality may be prevented.

Also, in the pixel circuit 100 of the electro-optic device according to the first exemplary embodiment of the present invention, the first node N1 is maintained at the reference potential Vbas during the data maintaining/supporting period such that the data maintaining/supporting voltage level of the second node N2 may be uniformly maintained.

Also, when applying the electro-optic device according to the first exemplary embodiment of the present invention to the display of a 3-D image, a display period for displaying the image and a non-display period for writing the image data are repeated. In this case, during the non-light-emitting period of the light emitting element (OLED) including the period (a) through the period (c) of FIG. 2, black is displayed on the entire screen, and the entire screen concurrently (e.g., simultaneously) displays the image during the period (d) of FIG. 2.

Accordingly, by synchronization of a shutter control timing of shutter spectacles to confirm the 3-D image by the naked eye into the light emitting period and the non-light-emitting period, high quality may be achieved without crosstalk in which the image for one eye is mixed with the image for the other eye.

However, in the present invention, the driving method of the pixel circuit 100 of the electro-optic device is not limited thereto.

Next, an exemplary variation of the driving method of the pixel circuit 100 of the electro-optic device according to the first exemplary embodiment of the present invention will be described.

Figure 4:
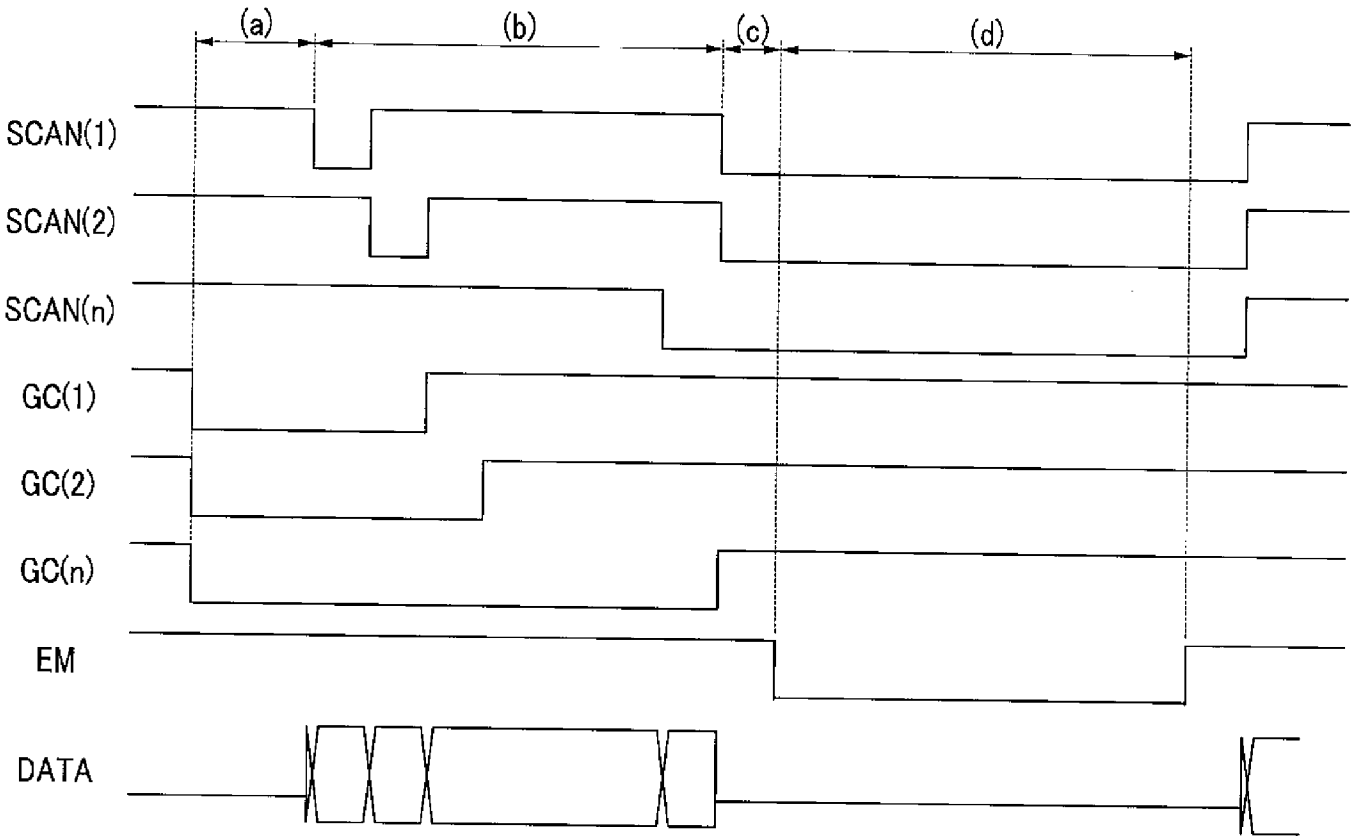
FIG. 4 is a diagram of an exemplary variation of a timing chart of each signal used to drive the pixel circuit of an electro-optic device according to the first exemplary embodiment of the present invention.

FIG. 4 is a diagram of an exemplary variation of a timing chart of each signal to drive the pixel circuit 100 of an electro-optic device according to the first exemplary embodiment of the present invention.

In the timing chart shown in FIG. 4, differently from FIG. 2, the control pulse supplied to the signal line GC is different in each row.

Accordingly, usage of the control pulse supplied to the signal line GC(1) of the first row, the control pulse supplied to the signal line GC(2) of the second row, . . . , and the control pulse supplied to the signal line GC(n) of the n-th row is shown in FIG. 4.

For the period (b) of FIG. 4, the control pulse supplied to the signal line GC 1 of the first row is converted from the low level to the high level after a time that the control pulse supplied to the scan line SCAN 1 of the first row is converted from the low level to the high level after the scan line SCAN 1 of the first row is selected.

The control pulse supplied to the signal line GC 1 of the first row is converted from the low level to the high level after the time that the control pulse supplied to the scan line SCAN 1 of the first row is converted from the low level to the high level such that the second transistor M2 of the pixel circuit 100 of the corresponding row is turned off.

The second transistor M2 is turned off at the time that the selection of the scan line SCAN is completed such that the potential of the second node N2 may be stable, and it is possible to maintain the desired potential at the second node N2 when the reference potential is applied to the data line during the period (c) later.

As described above, in the pixel circuit 100 of the electro-optic device according to the first exemplary embodiment of the present invention, the data voltage VDATA corresponding to the selected pixel is written to the first node N1 from the data line DATA through the third transistor M3 during a period in which the threshold voltage of the first transistor M1 is compensated.

Accordingly, in the pixel circuit 100 of the electro-optic device according to the first exemplary embodiment of the present invention, the capacitor occupying a relatively large area on a layout of the pixel circuit 100 is limited to one capacitor $C_{ST}$, and concurrently (e.g., simultaneously) the increase of the compensation time of the threshold voltage of the first transistor M1 and the increase of the data writing time may be realized in the surface sequential driving described above.

Accordingly, in the electro-optic device according to the first exemplary embodiment of the present invention, the compensation time of the threshold voltage of the driving transistor and the data writing time may be sufficiently obtained while reducing the number of elements of the pixel circuit such that the deterioration of the display quality may be prevented or reduced.

In the pixel circuit 100 of the electro-optic device according to the first exemplary embodiment of the present invention, the control timing of all signal lines GC may be the same or may be changed for each row.

When changing the control timing of the signal line GC, the second transistor M2 is turned off at the time that the selection of the scan line SCAN is completed such that the potential of the second node N2 may be stable. Also, the reference potential is applied to the data line in the later period (c) such that it is possible to maintain the desired potential at the second node N2.

<2. Second Exemplary Embodiment>

[Constitution of the Pixel Circuit of the Electro-optic Device]

Next, a constitution of the pixel circuit of the electro-optic device according to a second exemplary embodiment of the present invention will be described.

Figure 5:
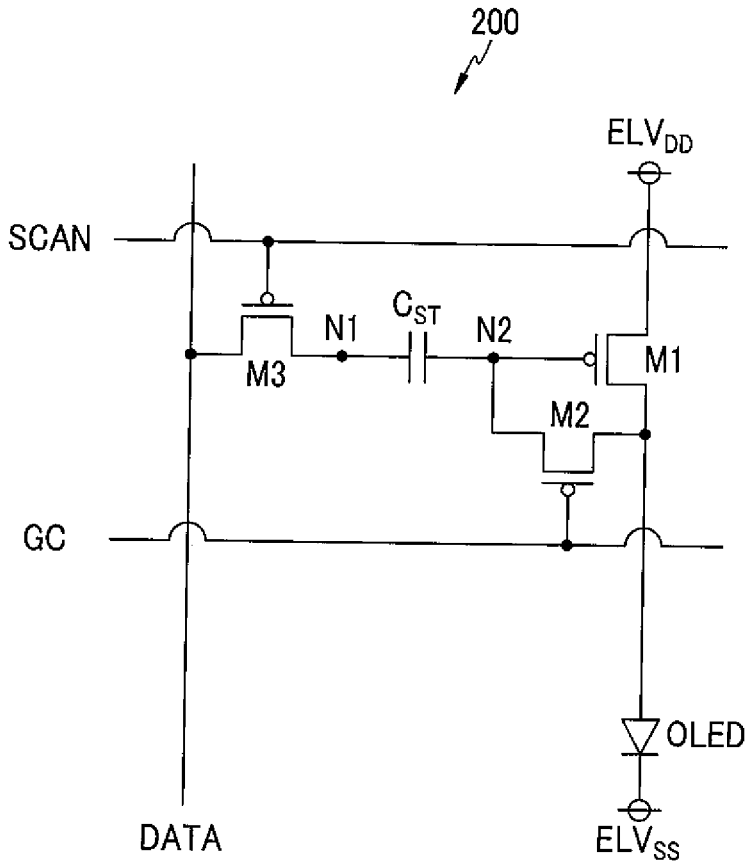
FIG. 5 is a diagram of a pixel circuit of an electro-optic device according to a second exemplary embodiment of the present invention.

FIG. 5 is a diagram of a pixel circuit 200 of an electro-optic device according to the second exemplary embodiment of the present invention.

The electro-optic device of a matrix type according to the second exemplary embodiment of the present invention includes the pixel circuit 200 shown in FIG. 5, and the pixel circuit 200 is disposed at a crossing position of, for example, a scan line of an n-th row and a data line of an m-th column.

Next, the pixel circuit 200 of the electro-optic device according to the second exemplary embodiment of the present invention will be described with reference to FIG. 5.

As shown in FIG. 5, the pixel circuit 200 of the electro-optic device according to the second exemplary embodiment of the present invention includes the first transistor M1, the second transistor M2, the third transistor M3, the capacitor $C_{ST}$, and a light emitting element (e.g., an organic light emitting element) (OLED).

The pixel circuit 200 shown in FIG. 5 has a constitution in which the fourth transistor M4 is omitted from the pixel circuit 100 shown in FIG. 1.

The first transistor M1 includes the first terminal connected to the first power source $ELV_{DD}$, the gate connected to the second node N2, and the second terminal connected to the second terminal of the second transistor M2 and the anode of the light emitting element (OLED).

The second transistor M2 includes the first terminal connected to the second node N2, the gate connected to the signal line GC, and the second terminal connected to the drain of the first transistor M1 and the anode of the light emitting element (OLED).

The third transistor M3 includes the first terminal connected to the data line DATA, the gate connected to the scan line SCAN, and the second terminal connected the first node N1.

In the pixel circuit 200, the first transistor M1, the second transistor M2 and the third transistor M3 are all P channel MOSFETs.

The capacitor $C_{ST}$ includes one terminal connected to the first node N1 and the other terminal connected to the second node N2.

The scan line SCAN supplies the control pulse for controlling the on/off of the third transistor M3.

The third transistor M3 is turned on or off by the control pulse supplied to the scan line SCAN.

The data line DATA supplies the data signal to the pixel circuit 200.

If the third transistor M3 is turned on by the control pulse supplied to the scan line SCAN, the data voltage corresponding to the pixel circuit 200 is written to the first node N1 through the third transistor M3.

The signal line GC supplies the control pulse for turning the second transistor M2 on or off.

The second transistor M2 is turned on or off by the control pulse supplied to the signal line GC.

The light emitting element (OLED), e.g., an organic light emitting element, is an element that self-emits light according to an amount of current flowing between an anode and a cathode.

In the present exemplary embodiment, if the potential of the second power source $ELV_{SS}$ is lower than the potential of the first power source $ELV_{DD}$, the current according to the potential maintained at the second node N2 of the pixel circuit 200 flows to the light emitting element (OLED), and thereby the light emitting element (OLED) is self-emissive by this current.

In the electro-optic device according to the second exemplary embodiment of the present invention, for all pixel circuits 200, the potential of the second power source $ELV_{SS}$ is controlled to be lower than the potential of the first power source $ELV_{DD}$.

Accordingly, the electro-optic device according to the second exemplary embodiment of the present invention is driven with the surface sequence.

The constitution of the pixel circuit 200 of the electro-optic device according to the second exemplary embodiment of the present invention is described with reference to FIG. 5.

Next, a driving method of the pixel circuit 200 of the electro-optic device according to the second exemplary embodiment of the present invention will be described.

[Driving Method of the Pixel Circuit of the Electro-optic Device]

Figure 6:
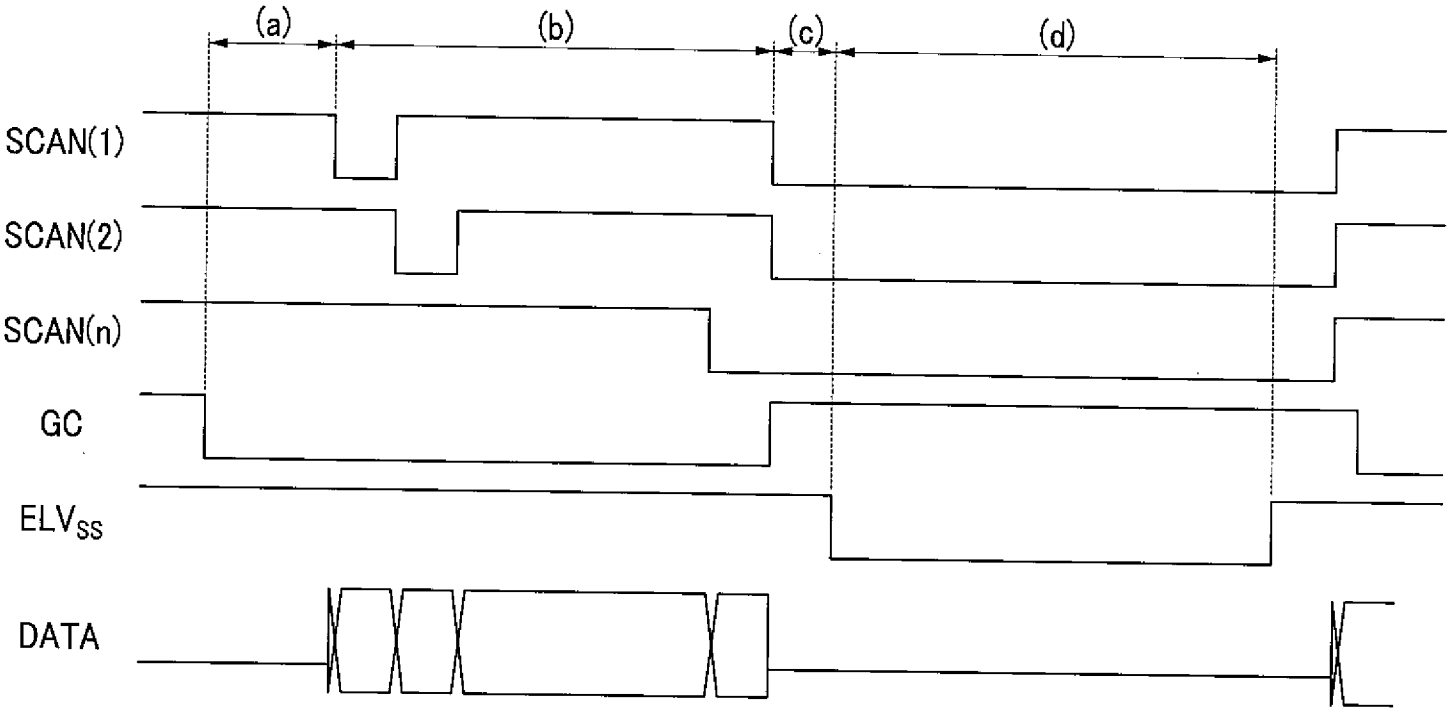
FIG. 6 is a diagram of a timing chart of each signal used to drive the pixel circuit of an electro-optic device according to the second exemplary embodiment of the present invention.

FIG. 6 is a diagram of a timing chart of each signal used to drive the pixel circuit 200 of an electro-optic device according to the second exemplary embodiment of the present invention, and FIG. 7A through FIG. 7D are diagrams of several driving states of the pixel circuit 200 of an electro-optic device according to the second exemplary embodiment of the present invention.

Next, a driving method of the pixel circuit 200 of the electro-optic device according to the second exemplary embodiment of the present invention will be described with reference to FIG. 6 and FIG. 7A through FIG. 7D.

In the timing chart shown in FIG. 6, the control pulses respectively supplied to the scan line SCAN(1) of the first row, the scan line SCAN(2) of the second row, and the scan line SCAN(n) of the n-th row, the control pulse supplied to the signal line GC, and the data signal supplied to the data line DATA, are shown.

The control pulse supplied to the controlling line EM in the timing chart shown in FIG. 2 is not used in FIG. 6. The voltage level of the second power source $ELV_{SS}$ is described instead, and the rest of the description is the same as the timing chart shown in FIG. 2.

Figure 7A:
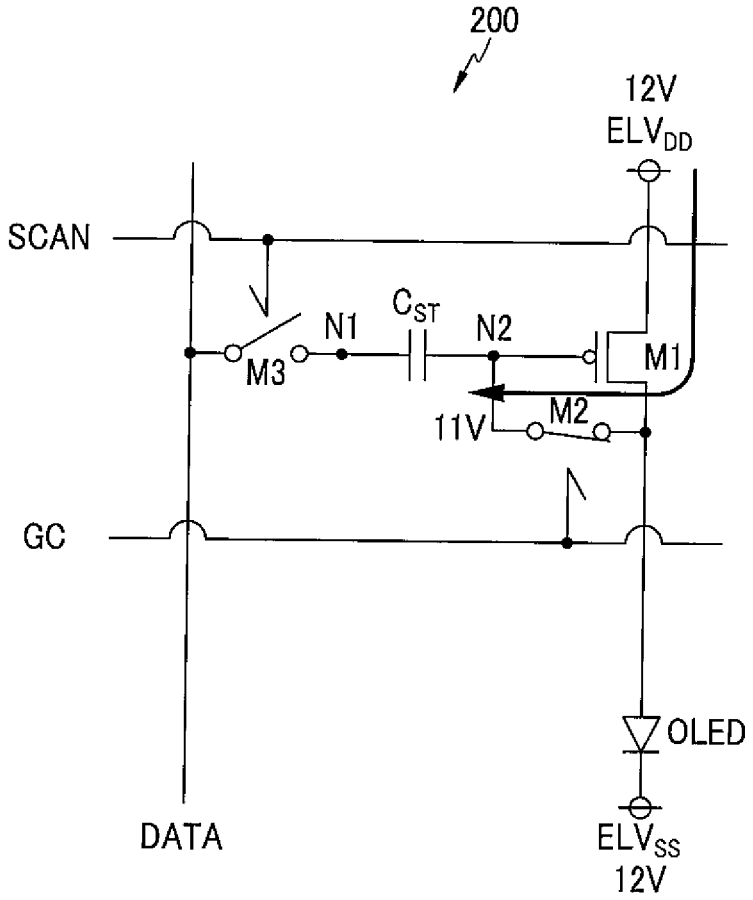
FIG. 7A is a diagram of a driving state of the pixel circuit of an electro-optic device according to the second exemplary embodiment of the present invention.

For the period (a) of FIG. 6 and as illustrated in FIG. 7A, in the state in which the second power source $ELV_{SS}$ is maintained as the high level, the control pulse supplied to the signal line GC is the low level such that the second transistor M2 is turned on.

As a result, the light emitting element (OLED) enters a non-light-emitting state, and the first transistor M1 enters a diode connection state (e.g., diode-connected).

By the diode connection state of the first transistor M1 according to the turning-on of the second transistor M2, the voltage of the second node N2 starts to be changed toward a voltage equal to $ELV_{DD}$-Vth (Vth is a threshold voltage of the first transistor M1).

In FIG. 7A, it is assumed that $ELV_{DD}$=12 V and Vth=1 V.

In the present invention, the values of $ELV_{DD}$ and Vth are not limited thereto.

Figure 7B:
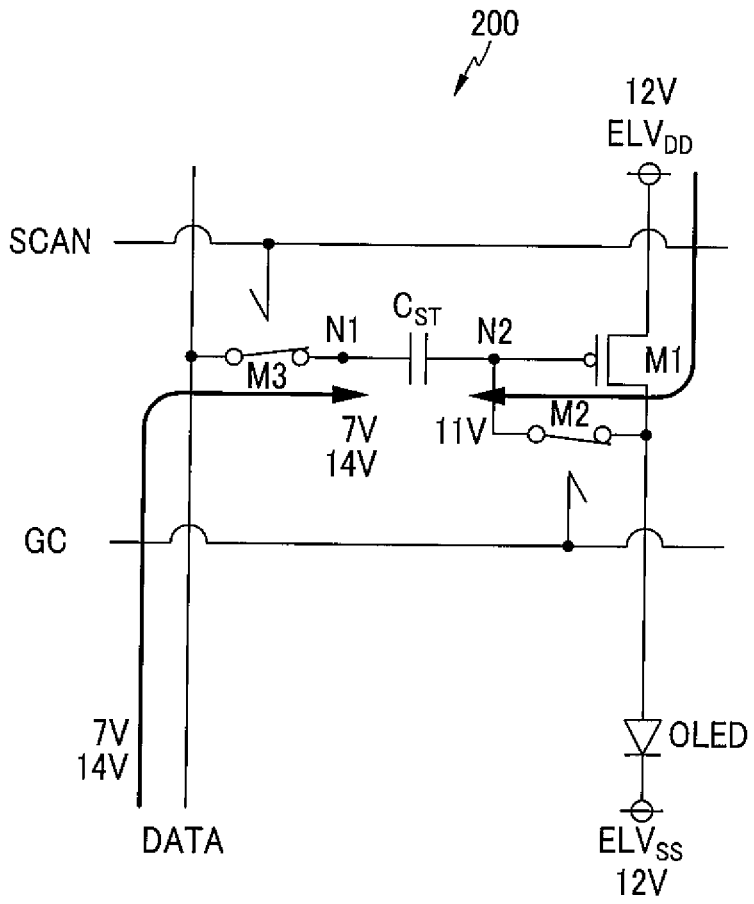
FIG. 7B is a diagram of a driving state of the pixel circuit of an electro-optic device according to the second exemplary embodiment of the present invention.

Continuously, for the period (b) of FIG. 6 and as illustrated in FIG. 7B, each scan line SCAN(1), SCAN(2), SCAN(n) are sequentially and exclusively selected, and the third transistor M3 on the selected scan line is turned on.

If the third transistor M3 on the selected scan line is turned on, the data voltage VDATA corresponding to the selected pixel is written to the first node N1 through the third transistor M3 from the data line DATA.

For the period (b) of FIG. 6, the data voltage VDATA supplied from the data line DATA is appropriately determined by a gray level or degree and a reference potential Vbas that will be described later. In the exemplary embodiment of FIG. 7B, the data voltage VDATA is determined as being in a range of about 7 V to about 14 V.

For the period (b) of FIG. 6, the first transistor M1 maintains the diode connection state such that the voltage of the second node N2 is continuously changed until the voltage is substantially equal to $ELV_{DD}$-Vth, and the voltage charged to the capacitor CST becomes $ELV_{DD}$-Vth-VDATA with reference to the first node N1.

Figure 7C:
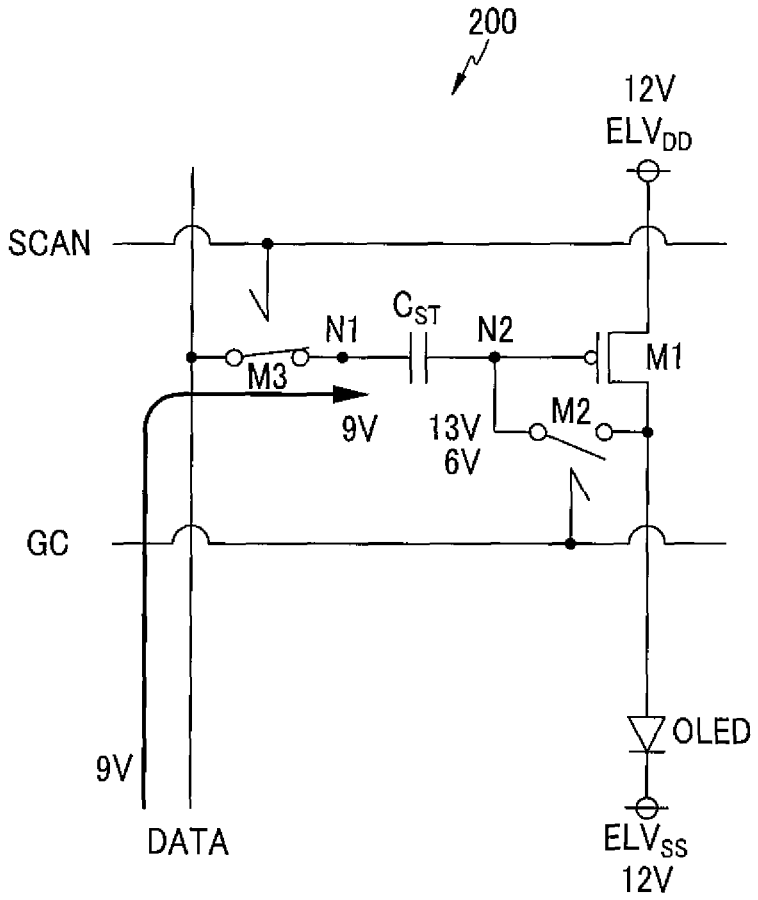
FIG. 7C is a diagram of a driving state of the pixel circuit of an electro-optic device according to the second exemplary embodiment of the present invention.

Next, for the period (c) of FIG. 6 and as illustrated in FIG. 7C, by transmitting the control pulse supplied to the signal line GC as the high level, the second transistor M2 is turned off, and concurrently (e.g., simultaneously) all scan lines SCAN(1), SCAN(2), . . . , SCAN(n) are concurrently (e.g., simultaneously) selected such that the third transistor M3 of all pixel circuits 100 are turned on.

For the period (c) of FIG. 6, the data voltage VDATA is applied with a reference potential Vbas (e.g., in FIG. 3C, 9 V) such that the potential Vbas is written to the first node N1 of all pixel circuits 200 through the third transistor M3.

Because the potential Vbas is written to the first node N1, the potential of the second node N2 becomes $ELV_{DD}$-Vth-VDATA+Vbas by capacitive coupling of the capacitor CST.

Accordingly, when the data voltage VDATA has the range of about 7 V to about 14 V, the potential of the second node N2 has the range of about 6 V to about 13 V.

Figure 7D:
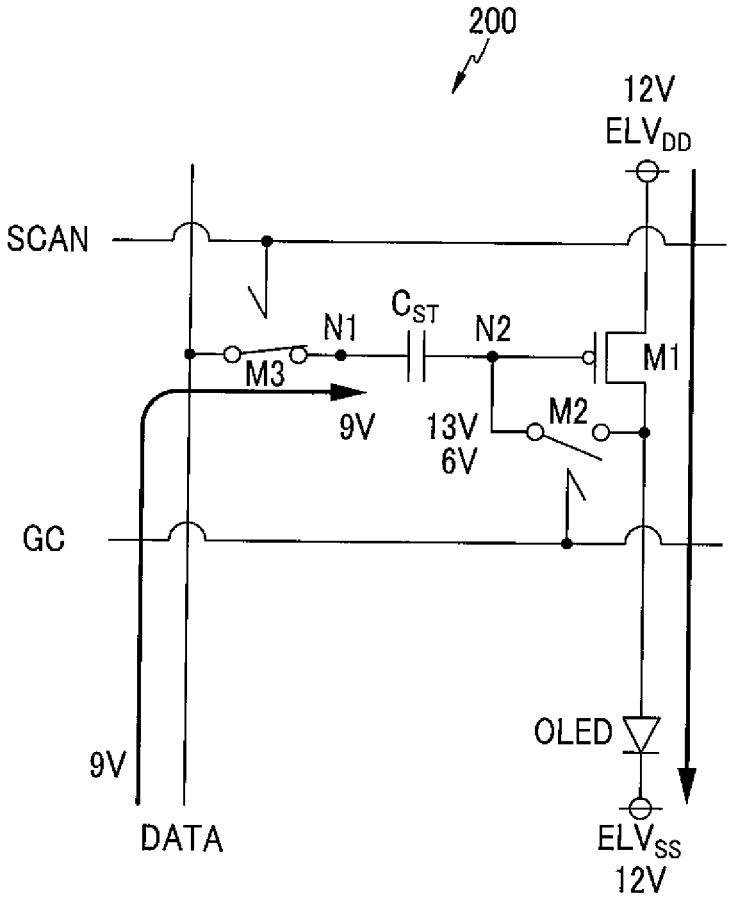
FIG. 7D is a diagram of a driving state of the pixel circuit of an electro-optic device according to the second exemplary embodiment of the present invention.

Continuously, for the period (d) of FIG. 6 and FIG. 7D, for all pixel circuits 200, the second power source $ELV_{SS}$ is applied as the low level such that the current concurrently (e.g., simultaneously) flows to the light emitting element (OLED) for all pixel circuits 200.

Because the second power source $ELV_{SS}$ is at the low level, the light emitting of the light emitting element (OLED) according to the potential maintained by the second node N2 of each pixel circuit 200 is performed.

Also, from the period (c) of FIG. 6, the third transistor M3 is continuously turned on such that the first node N1 is maintained as a reference potential Vbas.

The first node N1 is maintained as a reference potential Vbas such that the potential $ELV_{DD}$-Vth-VDATA+Vbas of the second node N2 is maintained during the period (d).

The driving method of the pixel circuit 200 of the electro-optic device according to the second exemplary embodiment of the present invention is described above.

By driving the pixel circuit 200 of the electro-optic device according to the second exemplary embodiment of the present invention as described above, the capacitor occupying a relatively large area on a layout of the pixel circuit 200 may be limited to one capacitor $C_{ST}$.

Also, in the pixel circuit 200 of the electro-optic device according to the second exemplary embodiment of the present invention, for the surface sequential driving, an increase of the compensation time of the threshold voltage of the first transistor M1 and the increase of the data writing time may be realized.

Accordingly, in the electro-optic device according to the second exemplary embodiment of the present invention, the compensation time of the threshold voltage of the first transistor M1 and the data writing time may be sufficiently obtained while reducing the number of elements in the pixel circuits such that the deterioration of the display quality may be prevented or reduced.

Also, in the pixel circuit 200 of the electro-optic device according to the second exemplary embodiment of the present invention, the first node N1 is maintained as the reference potential Vbas during the data maintaining/supporting period such that the data maintaining/supporting voltage level of the second node N2 may be uniformly maintained.

<3. Third Exemplary Embodiment>

[Constitution of the Pixel Circuit of the Electro-optic Device]

Next, a constitution of a pixel circuit of an electro-optic device according to a third exemplary embodiment of the present invention will be described.

Figure 8:
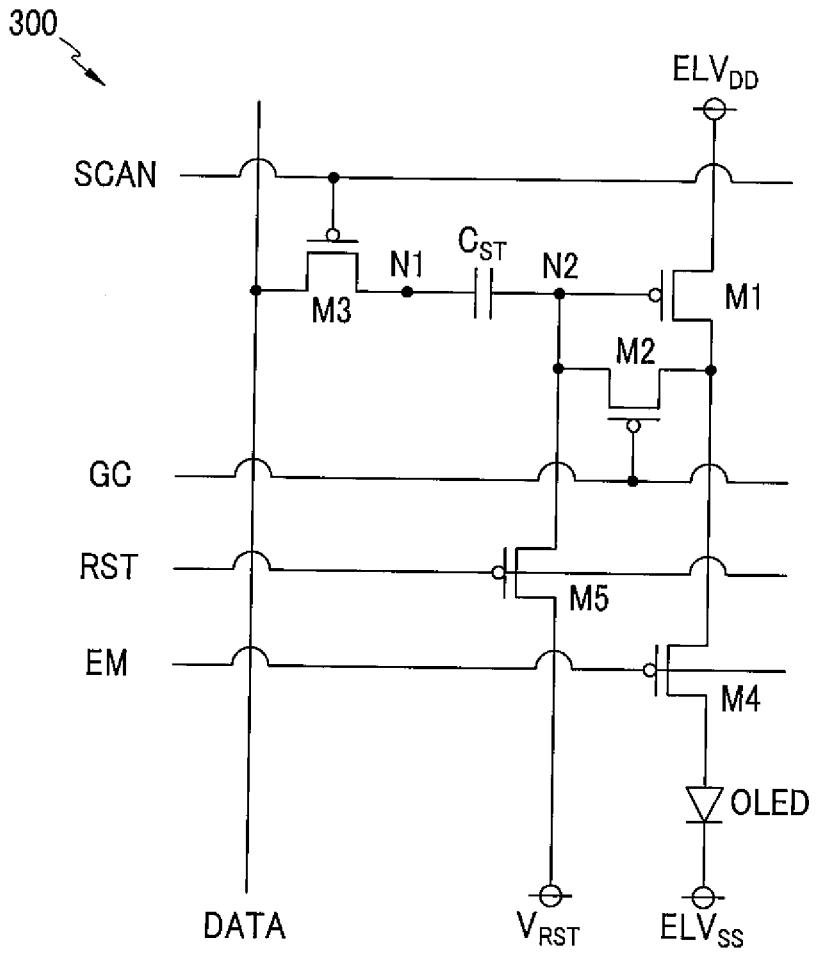
FIG. 8 is a diagram of a pixel circuit of an electro-optic device according to a third exemplary embodiment of the present invention.

FIG. 8 is a diagram of a pixel circuit 200 of an electro-optic device according to the third exemplary embodiment of the present invention.

The electro-optic device of a matrix type according to the third exemplary embodiment of the present invention includes the pixel circuit 300 shown in FIG. 8, and the pixel circuit 300 is disposed at a crossing position of a scan line of, for example, an n-th row and a data line of an m-th column.

Next, the pixel circuit 300 of the electro-optic device according to the third exemplary embodiment of the present invention will be described with reference to FIG. 8.

As shown in FIG. 8, the pixel circuit 300 of the electro-optic device according to the third exemplary embodiment of the present invention includes the first transistor M1, the second transistor M2, the third transistor M3, the fourth transistor M4, the fifth transistor M5, the capacitor $C_{ST}$, and the light emitting element (OLED).

The pixel circuit 300 shown in FIG. 8 has a constitution in which the fifth transistor M5 is added to the pixel circuit 100 shown in FIG. 1.

The fifth transistor M5 includes a first terminal connected to the second node N2, a gate connected to a reset line RST, and a second terminal connected to a reset power source $V_{RST}$.

After the current flows to the light emitting element (OLED) such that the light emitting element (OLED) emits light, the fifth transistor M5 connects the second node N2 to the reset power source VRST to set up the second node N2 as a predetermined reset potential $V_{RST}$.

In more detail, after the finishing of the light emitting period of the period (d) in FIG. 2, and before the start of the diode connection of the first transistor M1 of the period (a), a predetermined reset potential (VRST) that is sufficient to turn on the first transistor M1 is written to the second node N2.

After emitting the light emitting element (OLED), the second node N2 is connected to the reset power source $V_{RST}$ to set up the predetermined reset potential VRST, and particularly, when the display of the previous frame is a dark gray level, the time until the compensation completion of the threshold voltage of the first transistor M1 may be short.

<4. Fourth Exemplary Embodiment>

[Constitution of the Pixel Circuit of the Electro-optic Device]

Next, a pixel circuit of an electro-optic device according to a fourth exemplary embodiment of the present invention will be described.

Figure 9:
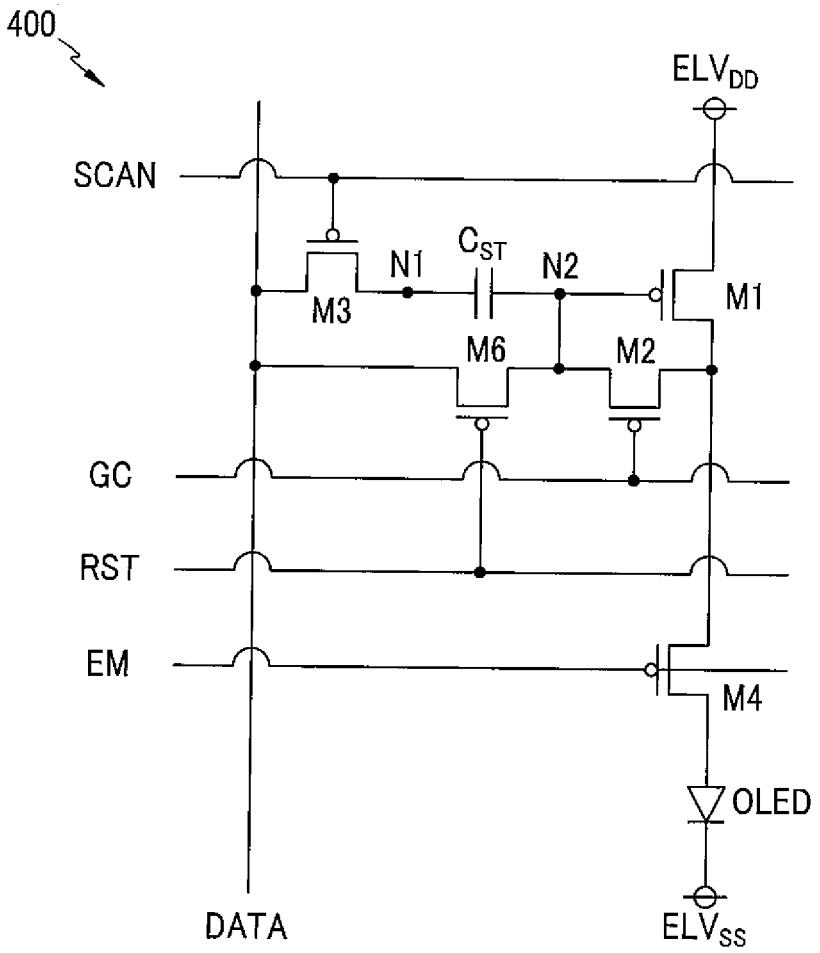
FIG. 9 is a diagram of a pixel circuit of an electro-optic device according to a fourth exemplary embodiment of the present invention.

FIG. 9 is a diagram of a pixel circuit 400 of an electro-optic device according to the fourth exemplary embodiment of the present invention.

The electro-optic device of a matrix type according to the fourth exemplary embodiment of the present invention includes the pixel circuit 400 shown in FIG. 9, and the pixel circuit 400 is disposed at a crossing position of a scan line of, for example, an n-th row and a data line of an m-th column.

Next, the pixel circuit 400 of the electro-optic device according to the fourth exemplary embodiment of the present invention will be described with reference to FIG. 9.

As shown in FIG. 9, the pixel circuit 400 of the electro-optic device according to the fourth exemplary embodiment of the present invention includes the first transistor M1, the second transistor M2, the third transistor M3, the fourth transistor M4, the sixth transistor M6, the capacitor ($C_{ST}$), and the light emitting element (OLED).

The pixel circuit 400 shown in FIG. 9 omits the fifth transistor M5 from the pixel circuit 300 shown in FIG. 8, and has a constitution in which the sixth transistor M6 is added.

The sixth transistor M6 includes a first terminal connected to the second node N2, a gate connected to the reset line RST, and a second terminal connected to the data line DATA.

Like the fifth transistor M5 of the pixel circuit 300 shown in FIG. 8, after the current flows to the light emitting element (OLED) for the light emitting of the light emitting element (OLED), the sixth transistor M6 sets up the second node N2 as a predetermined reset potential VRST.

In the pixel circuit 400 of the electro-optic device according to the fourth exemplary embodiment of the present invention, the second terminal of the sixth transistor M6 is connected to the data line DATA, and the reset potential VRST is supplied from the data line DATA for the described reset timing such that the same effect as the pixel circuit 300 of the electro-optic device according to the third exemplary embodiment of the present invention may be obtained.

Also, the pixel circuit 400 of the electro-optic device according to the fourth exemplary embodiment of the present invention does not use the power line for the reset potential VRST installed in the pixel circuit 300 of the electro-optic device according to the third exemplary embodiment of the present invention, such that the pixel circuit 400 is suitable to be used in an electro-optic device of high resolution.

Figure 10:
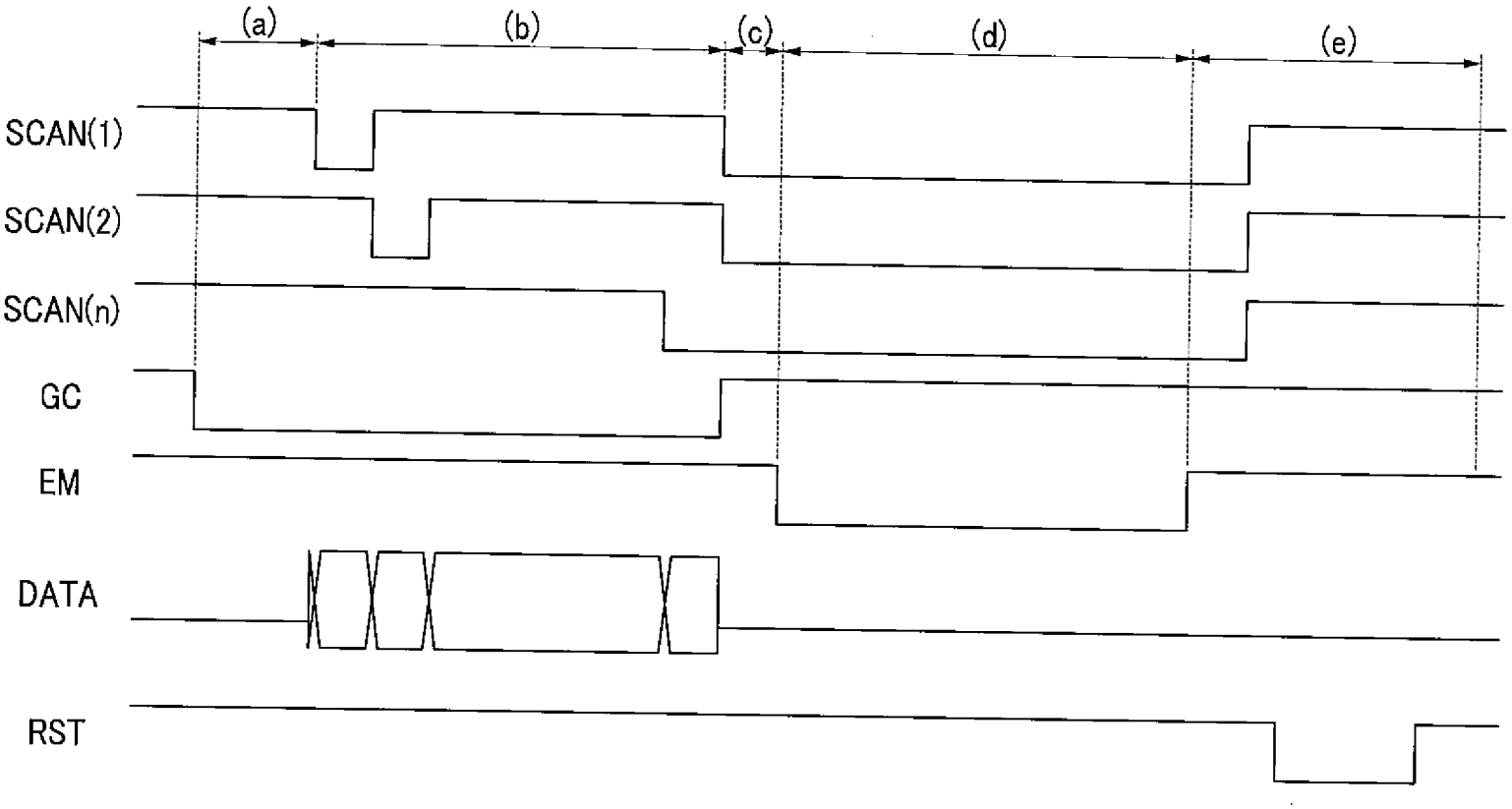
FIG. 10 is a diagram of a timing chart of each signal used to drive the pixel circuit of an electro-optic device according to the third exemplary embodiment of the present invention and the pixel circuit of an electro-optic device according to the fourth exemplary embodiment of the present invention.

FIG. 10 is a diagram of a timing chart of each signal used to drive the pixel circuit 300 of an electro-optic device according to the third exemplary embodiment of the present invention and the pixel circuit 400 of an electro-optic device according to the fourth exemplary embodiment of the present invention.

The timing chart shown in FIG. 10 explains the state of the control pulse applied to the reset line RST as well as the timing chart shown in FIG. 2.

As shown in FIG. 10, the control pulse applied to the reset line RST is supplied as the low level in the period (e) until the period (a) of the next frame, is started after the passage of the period (d).

The control pulse applied to the reset line RST during the period (e) is the low level such that the fifth transistor M5 (FIG. 8) or the sixth transistor M6 (FIG. 9) is turned on, and thereby the second node N2 is set as the predetermined reset potential VRST.

By setting the second node N2 as the predetermined reset potential VRST, particularly, when the display of the previous frame is the dark gray level, the time until the compensation completion of the threshold voltage of the first transistor M1 may be shortened.

<5. Summary>

As described above, according to each exemplary embodiment of the present invention, during the period in which the threshold voltage of the first transistor M1 is compensated, the data voltage VDATA corresponding to the selected pixel is written to the first node N1 from the data line DATA through the third transistor M3.

Accordingly, while the capacitor occupying the relatively large area on the layout of the pixel circuit is limited to one, and simultaneously, for the surface sequential driving, the increase of the threshold voltage compensation time of the first transistor M1 and the increase of the data writing time may be realized.

Also, in the electro-optic device according to each exemplary embodiment of the present invention, while reducing the number of elements of the pixel circuit, the threshold voltage compensation time of the driving transistor and the data writing time may be sufficiently obtained, and thereby the deterioration of the display quality may be prevented or reduced.

Also, in the electro-optic device according to each exemplary embodiment of the present invention, the first node N1 is maintained as the reference potential Vbas during the data maintaining/supporting period such that the data maintaining/supporting period of the second node N2 may be uniformly maintained.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Further, a person of ordinary skill in the art can omit part of the constituent elements described in the specification without deterioration of performance, or can add constituent elements for better performance. In addition, a person of ordinary skill in the art can change the specification depending on the process conditions or equipment. Hence, the scope of the present invention is to be determined by the claims and their equivalents.

DESCRIPTION OF SOME SYMBOLS

100, 200, 300, 400: pixel circuit
M1, M2, M3, M4, M5, M6: transistor
OLED: light emitting element
$C_{ST}$: capacitor
SCAN: scan line
DATA: data line
GC: signal line
EM: controlling line
RST: reset line
$ELV_{DD}$: first power source
$ELV_{SS}$: second power source
VRST: reset power source

What is claimed is:

1. A driving method of an electro-optic device including a first power source, a second power source, a plurality of data lines, a plurality of scan lines, a plurality of signal lines, and a plurality of pixel circuits formed at crossing regions of the data lines and the scan lines, wherein each of the pixel circuits comprises:

a light emitting element configured to emit light in response to a current flowing to the second power source from the first power source;

a first transistor comprising a first terminal connected to the first power source, a gate connected to a second node, and a second terminal connected to the second power source;

a second transistor comprising a first terminal connected to the gate of the first transistor at the second node, a gate connected to a corresponding one of the signal lines, and a second terminal connected to the second terminal of the first transistor;

a third transistor comprising a first terminal connected to a corresponding one of the data lines, a gate connected to a corresponding one of the scan lines, and a second terminal connected to a first node; and a capacitor comprising a terminal connected to the first node and another terminal connected to the second node, the method comprising, for the electro-optic device in which the light emitting element is configured to emit light in a predetermined period during one frame all together for all pixel circuits:

a first step in which the light emitting element is in a non-light-emitting state and the second transistor is turned on to diode-connect the first transistor in response to a pulse applied to the signal lines;

a second step occurring after the first step in which the scan lines are sequentially selected while the second transistor is turned on to diode-connect the first transistor, the third transistor including the gate connected to the selected scan line is turned on, and a corresponding data voltage is written to the first node from the data line through the third transistor; and a third step occurring after the second step in which all scan lines are concurrently selected to turn on the third transistor of each pixel circuit such that a predetermined reference voltage is written to the first node through the third transistor from the data line.

2. The driving method of claim 1, further comprising:

a fourth step in which the current flows to the second power source from the first power source, and the light emitting element emits light with a brightness corresponding to a voltage value of the second node after the third step.

3. The driving method of claim 2, wherein:

the electro-optic device further comprises a plurality of controlling lines;

each of the pixel circuits further comprises a fourth transistor including a first terminal connected to the second terminal of the first transistor, a gate connected to a corresponding one of the controlling lines, and a second terminal connected to an anode of the light emitting element; and for the fourth step, the fourth transistor is turned on in response to a pulse applied to the controlling line such that the current flows to the second power source from the first power source.

4. The driving method of claim 2, wherein for the fourth step, a potential of the second power source is lower than a potential of the first power source such that the current flows to the second power source from the first power source.

5. The driving method of claim 2, wherein:

the electro-optic device further comprises a plurality of reset lines and a reset power source;

each of the pixel circuits further comprises a fifth transistor including a first terminal connected to the second node, a gate connected to a corresponding one of the reset lines, and a second terminal connected to the reset power source; and after the fourth step, the fifth transistor is turned on in response to a pulse applied to the reset line such that the second node is connected to the reset power source to set a predetermined reset potential.

6. The driving method of claim 1, wherein for the third step, the second transistor of each of the pixel circuits is turned off all together for all of the pixel circuits.

7. The driving method of claim 1, wherein for the second step, the second transistor is sequentially turned off for every scan line.

8. A driving method of an electro-optic device including a first power source, a second power source, a plurality of data lines, a plurality of scan lines, a plurality of signal lines, and a plurality of pixel circuits formed at crossing regions of the data lines and the scan lines, wherein each of the pixel circuits comprises:

a light emitting element configured to emit light in response to a current flowing to the second power source from the first power source;

a first transistor comprising a first terminal connected to the first power source, a gate connected to a second node, and a second terminal connected to the second power source;

a second transistor comprising a first terminal connected to the second node, a gate connected to a corresponding one of the signal lines, and a second terminal connected to the second terminal of the first transistor;

a third transistor comprising a first terminal connected to a corresponding one of the data lines, a gate connected to a corresponding one of the scan lines, and a second terminal connected to a first node; and a capacitor comprising a terminal connected to the first node and another terminal connected to the second node, the method comprising, for the electro-optic device in which the light emitting element is configured to emit light in a predetermined period during one frame all together for all pixel circuits:

a first step in which the light emitting element is in a non-light-emitting state and the second transistor is turned on in response to a pulse applied to the signal lines;

a second step in which the scan lines are sequentially selected while the second transistor is turned on, the third transistor including the gate connected to the selected scan line is turned on, and a corresponding data voltage is written to the first node from the data line through the third transistor;

a third step in which all scan lines are concurrently selected to turn on the third transistor of each pixel circuit such that a predetermined reference voltage is written to the first node through the third transistor from the data line after the second step; and a fourth step in which the current flows to the second power source from the first power source, and the light emitting element emits light with a brightness corresponding to a voltage value of the second node after the third step, wherein:

the electro-optic device further comprises a plurality of reset lines;

each of the pixel circuits further comprises a sixth transistor including a first terminal connected to the second node, a gate connected to a corresponding one of the reset lines, and a second terminal connected to the data line; and after the fourth step, a potential of the data line is determined as a predetermined reset potential, and the sixth transistor is turned on in response to a pulse applied to the reset line such that the second node is connected to the data line to be set up as the predetermined reset potential.

9. An electro-optic device comprising a first power source, a second power source, a plurality of data lines, a plurality of scan lines, a plurality of signal lines, and a plurality of pixel circuits formed in crossing regions of the data lines and the scan lines, wherein each of the pixel circuits comprises:

a light emitting element configured to emit light in response to a current flowing to the second power source from the first power source;

a first transistor comprising a first terminal connected to the first power source, a gate connected to a second node, and a second terminal connected to the second power source;

a second transistor comprising a first terminal connected to the gate of the first transistor at the second node, a gate connected to a corresponding one of the signal lines, and a second terminal connected to the second terminal of the first transistor;

a third transistor comprising a first terminal connected to a corresponding one of the data lines, a gate connected to a corresponding one of the scan lines, and a second terminal connected to a first node; and a capacitor comprising a terminal connected to the first node and another terminal connected to the second node, wherein the light emitting element of each of the pixel circuits is configured to emit light in a predetermined period during one frame all together for all of the pixel circuits, wherein in a first period, the first transistor is configured to be diode-connected by turning on the second transistor in response to a pulse applied to the signal lines while the light emitting element is in a non-light-emitting state, wherein in a second period after the first period, the scan lines are to be sequentially selected while the second transistor is turned on in response to a pulse applied to the signal lines to diode-connect the first transistor so that a data voltage corresponding to the pixel circuit selected by scanning of a corresponding scan line is written to the first node from a corresponding data line through the third transistor during compensation of a threshold voltage of the first transistor, and wherein in a third period after the second period, the scan lines are to be concurrently selected to turn on the third transistor of each pixel circuit such that a predetermined reference voltage is written to the first node through the third transistor from the data line.

10. The electro-optic device of claim 9, further comprising a plurality of controlling lines, and each of the pixel circuits further comprises a fourth transistor including a first terminal connected to the second terminal of the first transistor, a gate connected to a corresponding one of the controlling lines, and a second terminal connected to an anode of the light emitting element.

11. The electro-optic device of claim 9, further comprising a plurality of reset lines and a reset power source, and each of the pixel circuits further comprises a fifth transistor including a first terminal connected to the second node, a gate connected to a corresponding one of the reset lines, and a second terminal connected to the reset power source.

12. The electro-optic device of claim 9, further comprising a plurality of reset lines, and each of the pixel circuits further comprises a sixth transistor including a first terminal connected to the second node, a gate connected to a corresponding one of the reset lines, and a second terminal connected to a corresponding one of the data lines.

13. The electro-optic device of claim 9, wherein the first transistor, the second transistor, and the third transistor are each a P-channel type metal-oxide-semiconductor field-effect transistor.

* * * * *